US011208300B2

(12) United States Patent
Wang et al.

(10) Patent No.: US 11,208,300 B2
(45) Date of Patent: Dec. 28, 2021

(54) SUPER LARGE TONNAGE DETACHABLE HOOK

(71) Applicant: Shanghai Maritime University, Shanghai (CN)

(72) Inventors: Yuemin Wang, Shanghai (CN); Xiang Gao, Shanghai (CN); Ying Shen, Shanghai (CN)

( * ) Notice: Subject to any disclaimer, the term of this patent is extended or adjusted under 35 U.S.C. 154(b) by 18 days.

(21) Appl. No.: 16/754,372

(22) PCT Filed: May 11, 2018

(86) PCT No.: PCT/CN2018/086486

§ 371 (c)(1),
(2) Date: Apr. 7, 2020

(87) PCT Pub. No.: WO2019/071948

PCT Pub. Date: Apr. 18, 2019

(65) Prior Publication Data

US 2020/0307961 A1 Oct. 1, 2020

(30) Foreign Application Priority Data

Oct. 9, 2017 (CN) ..... 201710928702.X

(51) Int. Cl.
*B66C 1/34* (2006.01)
*B66C 1/36* (2006.01)

(52) U.S. Cl.
CPC . *B66C 1/34* (2013.01); *B66C 1/36* (2013.01)

(58) Field of Classification Search
CPC ..... B66C 1/34; B66C 1/36; B66D 3/06
USPC ..... 294/82.1, 82.11
See application file for complete search history.

(56) References Cited

U.S. PATENT DOCUMENTS 2,823,944 A * 2/1958 Anderson ..... B66C 1/34 294/82.15
2,980,400 A * 4/1961 Long ..... B66C 1/34 254/401
6,991,275 B2 * 1/2006 Zollondz ..... B66C 1/34 294/82.15
7,293,763 B2 * 11/2007 Lutter ..... B66C 1/34 254/415

(Continued)

FOREIGN PATENT DOCUMENTS

CN 201512348 U * 6/2010

*Primary Examiner* — Dean J Kramer
(74) *Attorney, Agent, or Firm* — Lei Jiang

(57) ABSTRACT

The present invention discloses a super large tonnage detachable hook. The hook comprises: a hook rod, a hook shaft, a hook body, a spherical roller bearing, and a thrust spherical roller bearing. The hook also contains a connection component which connects the hook rod to the hook body. The split-type self-locking sleeve is integrally connected to the hook rod via the hook hoop holder. Meshing of the sleeve with the toothed sleeve of the hook rod is adopted to transmit the load, and the bearing capacity is greatly improved compared with the traditional screw connection. The hook of the present invention can withstand the downward and upward bi-directional load, which solves the problem that the traditional hook is prone to damage once it hits the ground. The hook is forged with 30CrNiMo8, which can lift an extremely large weight of more than 5,000 tons.

7 Claims, 10 Drawing Sheets

(56) References Cited

U.S. PATENT DOCUMENTS

| | | | | |
|---|---|---|---|---|
| 7,722,013 | B2 * | 5/2010 | Franzen | B66C 1/34 254/393 |
| 2013/0069379 | A1 * | 3/2013 | Passmann | B66C 1/34 294/82.1 |

* cited by examiner

SUPER LARGE TONNAGE DETACHABLE HOOK

CROSS-REFERENCE TO RELATED APPLICATIONS

The subject application is the national phase entry of PCT/CN2018/086486 filed on May 11, 2018, which claims priority on Chinese patent application 201710928702.X filed on Oct. 9, 2017. The contents and subject matter of the PCT international application and Chinese priority application are incorporated herein by reference.

FIELD OF INVENTION

The present invention relates to marine engineering equipment—a large tonnage lifting hook for a marine floating crane, and relates in particular to a novel super large tonnage detachable hook with a new structural form and made of a high-strength material, with a lifting capacity of one hook of 5,000 tons and above.

BACKGROUND ART

Lifting hook is an important pick-up tool for a crane to lift goods. It is widely used in port and ship operations, especially in the operation of a marine engineering floating crane, such as an offshore floating crane and an offshore platform. At the same time, lifting hook can also be employed as a working tool for various lifting cranes, while a large tonnage lifting hook is mainly utilized for a floating crane in marine engineering.

In the prior art, a lifting hook is categorized as detachable or integral type according to its structure. A detachable hook comprises a hook body, a hook rod, a hook nut, a thrust spherical roller bearing, a spherical roller bearing, etc. This type of lifting hook is manufactured in a split form and then assembled to a complete one. Since the hook body and the hook rod are separately manufactured, the size of the workpiece is small, the requirements for the processing equipment are low, and the manufacturing cost is accordingly low. However, because the hook body needs to be mounted with a bearing, a large stress concentration occurs at the joint surface of the bearing installation portion, especially at the corner, resulting in poor fatigue performance.

For lifting hooks with a same lifting capacity, the detachable hook has a lighter weight and a higher lifting capacity. The integral lifting hook, hook rod and hook body are integrated, resulting in a large outer shape and high requirements for manufacturing equipment and materials. Therefore, the world's largest integral lifting hook possessing a lifting capacity of 4,000 tons and lifting hooks with a lifting capacity of more than 4,000 tons are all detachable. In countries outside China, the method of casting molding is normally employed to manufacture a traditional large tonnage detachable hook. In China, although casting method is employed, the hook is shaped by the method of gauging and sanding. Due to the limits of the casting technique, the manufactured hooks have many defects, such as easy to crack in use and a short service life. The carbon gauging and sanding method can easily damage the heat treatment layer on the surface of the hook, resulting in unsmooth surface. Thus, the shape is not consistent with the design profile. The reasons aforementioned would influence the strength and wear resistance of the lifting hook and its fatigue life.

The hook rod and hook nut of a traditional detachable hook are connected by thread to bear the lifting capacity.

Because the bearing capacity of a single thread is small, the number of threads must be increased. How to ensure the machining accuracy of all threads and make all threads bear the load at the same time has become a difficult problem in machining. Moreover, during the hook assembly, the nut must be screwed up from the end of the hook rod until all threads are engaged. For large tonnage detachable hooks, the diameter of the nut and the number of engaged threads are large, which makes it difficult to screw nuts and assemble.

The above defects are not adaptable to the trend of the large-scale construction of offshore construction equipment, which seriously restricts the further development of offshore construction equipment.

With the development of offshore equipment technology towards large scale and high-tech, the existing lifting hook operation shows the following characteristics. 1. The lifting capacity of a lifting hook is getting larger and larger; 2. Hook operation is more and more frequent; 3. Working conditions of the lifting hook are more and more varied; 4. Working efficiency of a lifting hook is increasingly higher; 5. The safety requirements are getting ever more stringent.

Therefore, the hook, as the most important lifting tool of the floating crane, must be innovated in structure, material, processing technology and other aspects, so as to ensure that it can meet the requirements of high strength, large bearing capacity, high safety, easy assembly and long service life on the premise of reducing the self-weight, and adapt to the development trend of the floating crane.

SUMMARY OF THE INVENTION

The purpose of the present invention is to solve the defects of traditional lifting hooks—not large enough lifting capacity, short service life, inability to endure high-strength and high-frequency operation, and to propose a new super large tonnage detachable hook made of a high-strength material with a lifting capacity of one hook of 5,000 tons and above, which adopts the form of two or four claws, and the four-claw hook only needs two claws to lift 5,000 tons and above.

To achieve the above purpose, the present invention provides a super large tonnage detachable hook, which comprises a hook rod, a hook shaft, a hook body, a spherical roller bearing, and a thrust-force spherical roller bearing; the detachable hook of the present invention further comprises an embracing-type hoop holder assembly connecting the hook rod and the hook body. The embracing-type hoop holder assembly comprises a split-type self-locking sleeve and a hook hoop holder arranged below the thrust spherical roller bearing. Among them, the split-type self-locking sleeve is integrated into the embracing-type hoop holder assembly with the hook rod via the hoop holder, forming a fixed connection. The lower part of the hook rod is arranged with a groove at the joint between the embracing-type hoop holder assembly and the split-type self-locking sleeve. A bump matching the groove is provided. The groove and the bump form a couple of bearing pair. The split-type self-locking sleeve is designed as two symmetric halve parts. Assembly of the embracing-type hoop holder assembly is as follows: firstly hang up the hook rod through the hoop holder, then, the groove on the hook rod extends downward from the hoop holder, and the two halve parts forming the split-type self-locking sleeve close from both sides to hold the hook rod, and then the hoop holder subsides and holds the split-type self-locking sleeve to make the embracing-type hoop holder assembly an integral entity.

A hook rod shoulder above the hook rod engages with a chain bracket is used to ensure axial positioning, which solves the problem that a traditional hook can only bear the downward load. Such a structure of the present invention transmits the upward load to the hook shaft when the hook body touches the ground and solves the problem that the traditional hook can only bear the downward load, so that the thrust bearing can avoid this kind of force damage occurring during operation. It can reverse load by means of the chain bracket and the hook rod and transmit the load to the hook shaft. It can ensure the integrity of the thrust bearing and avoid damage. In case the hook hits on the ground, it would not occur that the lower thrust bearing be separated and damaged as in the case of the traditional hook resulting from jacking up of the hook body. This feature of the detachable hook of the present invention meets the requirements of offshore construction operations. If the traditional hook is subject to the reverse force on the ground, the inner and outer rings of the thrust bearing will be separated from one another. Unless they instantly return to original state, the thrust bearing become irrevocably damaged.

An installation hole is provided at an upper part of the hook rod to connect the hook shaft and a sliding bearing is provided between the installation hole and the hook shaft, to make the whole hook rotate flexibly and to minimize horizontal load exerted on the hook rod.

The embracing-type hoop holder assembly further comprises a bottom cover for fixing the hoop holder with the split-type self-locking sleeve, wherein a stop block is installed on the bottom cover and engages with the groove at the bottom of the hook rod to prevent the hook rod from rotating.

The hook rod, the hook body, the split-type self-locking sleeve and the hoop holder of the detachable hook are integrally forged respectively employing a high-strength alloy steel 30CrNiMo8, processed with heat treatment, and formed in a machining center and assembled, enjoying advantages of high-strength material, compact structure, few defects, high surface hardness, high wear resistance, high dimensional accuracy and long service life. The hook body comprises two or more hook claws, and preferably four hook claws. For the four-claw hook, only two of the four claws are need to lift 5,000 tons and above.

The whole bearing part of the hook is integrally forged, including the hook tip portion and the hook body, revolutionizing the welded structure of the hook tip and the hook body of traditional hooks, and solving the problem that the hook tip is separated from the hook body under pulling force of the wire rope of the stable hook during the offshore operation. A Chamfer is arranged at bearing installation portion where the load is largest to reduce stress concentration and thus avoid fatigue crack and enhance its service life. In prior art, the hook tip of the hook is welded with the hook body, while the present invention adopts a forging process, which effectively avoids the problem of the hook tip and the hook body being prone to separation due to lifting load.

Preferably, a central oil hole is provided at the bottom of the hook rod to refuel from the bottom so that oil enters the inside of the thrust spherical roller bearing via an oil groove and an effective lubrication is achieved, to enhance the service life of the bearing. The use of a central oil hole to lubricate the bearing from the bottom is not employed in prior art. Instead, prior art employs a grease nipple on the side bearing cap for oil lubricating. Further, a rubber sealing ring is arranged between the rotating parts and the non-rotating parts of the detachable hook of the present invention, so that sea water and salt mist at sea are prevented from entering the inside of the hook body and bearing protection is achieved, to extend the service life of the bearing. The detachable hook of the present invention can withstand a certain water pressure to achieve underwater operation of the hook.

Preferably, four threaded holes are set on the outside of the smooth conical-shape hoop holder, which can be installed with the help of four bolts and employed as hoisting points when necessary.

The present invention possesses the following advantages over the prior art:

1. Main load-bearing components of the detachable hook of the present invention, including the hook rod, the hook body, the sleeve and the hoop holder, are integrally forged respectively employing a high-strength alloy steel 30CrNiMo8, and formed in machining centers after heat treatment, thus possessing advantages of high-strength material, compact structure, few defects, high surface hear treatment performance, high wear resistance, and high dimensional accuracy. It ensures the hook to possess the lifting capacity of 5,000 tons and above, on the premise of reducing the weight and ensuring the service life. A traditional detachable hook is forged, with lifting capacity of less than 4,000 tons and made of the low-strength material of 20Mn or 35 #steel; the hook body and hook tip are forged separately and welded; and the shape of the hook body is forged, heat treated and then carbon planed and polished. All of these make the traditional detachable hook have heavy weight, poor overall mechanical performance, large hook shape deviation, poor surface heat treatment performance, not wear-resistant, easy to crack and short service life.

2. The present invention innovatively applies the embracing-type hoop holder assembly, the split-type self-locking sleeve and the hook rod teeth to transfer load. The split-type self-locking sleeve has two symmetrical parts; wherein the hook rod is firstly put through the hoop holder so that the groove on the hook rod can go downward out of the hoop holder, and then the split-type self-locking sleeve closes from both sides to hold the groove before the hoop holder subsides to hold the split-type self-locking sleeve to become an integral entity. It solves the problems of small bearing capacity, and many processing and assembly difficulties caused by the hook rod and hook nut of a traditional detachable hook being connected by thread to bear the lifting capacity, and further overcomes the key technology of heavy lifting hook. Because the bearing capacity of a single thread is small, the number of threads must be increased. How to ensure the machining accuracy of all threads and make all threads bear the load at the same time has become a difficult problem in machining. Moreover, during hook assembly, the nut must be screwed up from the end of the hook rod until all threads are engaged. For large tonnage detachable hooks, the diameter of the nut and the number of engaged threads are large, which makes it difficult to screw nuts and assemble and thus restricts the large-scale construction of lifting hooks.

3. A rubber seal ring is used on the detachable hook to seal all relatively moving parts, to prevent sea water or salt mist from entering the inside of the hook body under certain pressure, i.e. in certain water depth, to protect the bearing, to prolong bearing life, and to adapt to the special environmental conditions of offshore construction. In order to solve the sealing problem, a traditional detachable hook welds a circular cover at the bottom of the hook body, and connects the bottom cover with bolts to protect the hook and the bearing. In comparison, the hook body itself of prior art is forged, which has poor welding performance and is easy to produce welding cracks, and it can also damage the heat treatment performance of the surface of the hook body, thus reducing the service life of the hook.

4. The present invention innovatively adopts a two-way force transmission system, where the hook can transfer the reverse load to the hook shaft by means of the hook frame and the hook rod in occurrence of any reverse force when the hook lands on ground and when the hook has to bear the downward lifting load. In such a scenario, integrity of the thrust bearing is still preserved and damage is prevented. A traditional detachable hook uses a one-way force system, where only downward load can be born. Once the hook lands on the ground, the bottom cover lifts the hook body up through the circular cover because there is a large gap between the bottom cover and the hook nut, so that the inner and outer rings of the lower thrust bearing are separated. If the inner and outer rings of the thrust bearing cannot return to original state during the next lifting, the bearing will be easily damaged.

Figure 1:
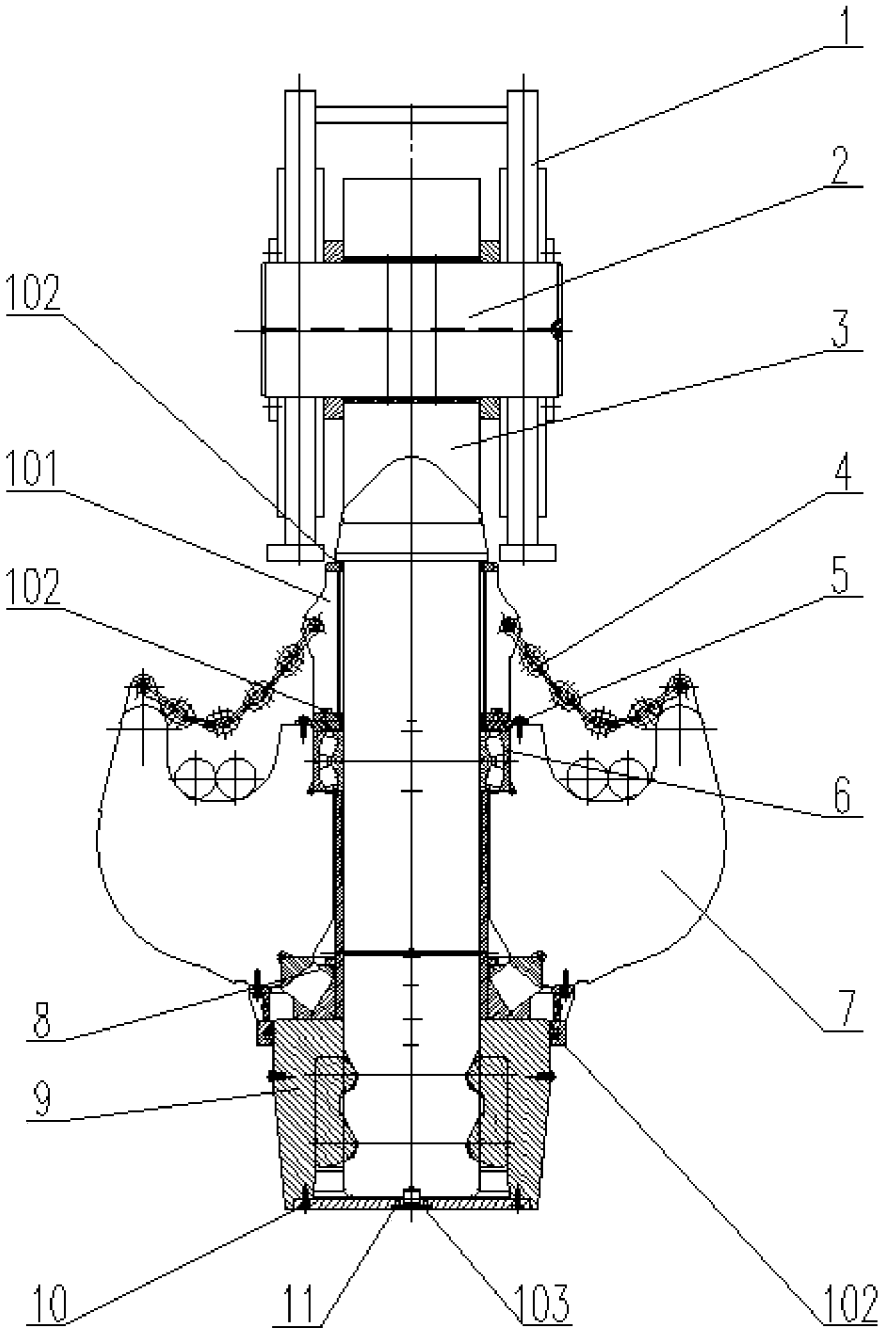
FIG. 1 is an assembly graph for a super large tonnage detachable hook disclosed by the present invention

Reference signs in the drawings are designated as follows: 1: hook beam, 2: hook shaft, 3: hook rod, 4: hook retaining chain, 5: lock plate, 6: spherical roller bearing, 7: hook body, 8: thrust spherical roller bearing, 9: embracing-type hoop holder assembly, 10: bottom cover, 11: grease nipple, 13: chamfer, 21: sliding bearing, 22: shaft-end baffle, 31: hook rod head, 32: hook installation hole, 33: central oil hole, 34: hook rod tooth, 35: non-rotating groove, 36: hook rod shoulder, 71: hook tip, 72: chain lock hole, 91: split-type self-locking sleeve, 92: hoop holder, 93: bolt, 101: chain bracket, 103: stop block, 701: first hook claw, 702: second hook claw, 703: third hook claw, 704: fourth hook claw, 901: sleeve groove.

EMBODIMENTS

The present invention will be further described hereinafter by elaborating a preferable embodiment with reference to FIG. 1-10.

As shown in FIG. 1, a super large tonnage detachable hook disclosed by the present invention comprises a hook beam 1, a hook shaft 2, a hook rod 3, a hook retaining chain 4, a chain bracket 101, a sealing ring 102, a bearing cover 5, a hook body 7, a spherical roller bearing 6 arranged above the hook body 7, a thrust spherical roller bearing 8 arranged beneath the hook body 7, an embracing-type hoop holder assembly 9 arranged beneath the thrust spherical roller bearing 8, a bottom cover 10, a grease nipple 11, and an stop block 103. A bearing cover and an anti-groove jumping device which can rotate along with the hook body are provided on the spherical roller bearing 6.

Figure 2:
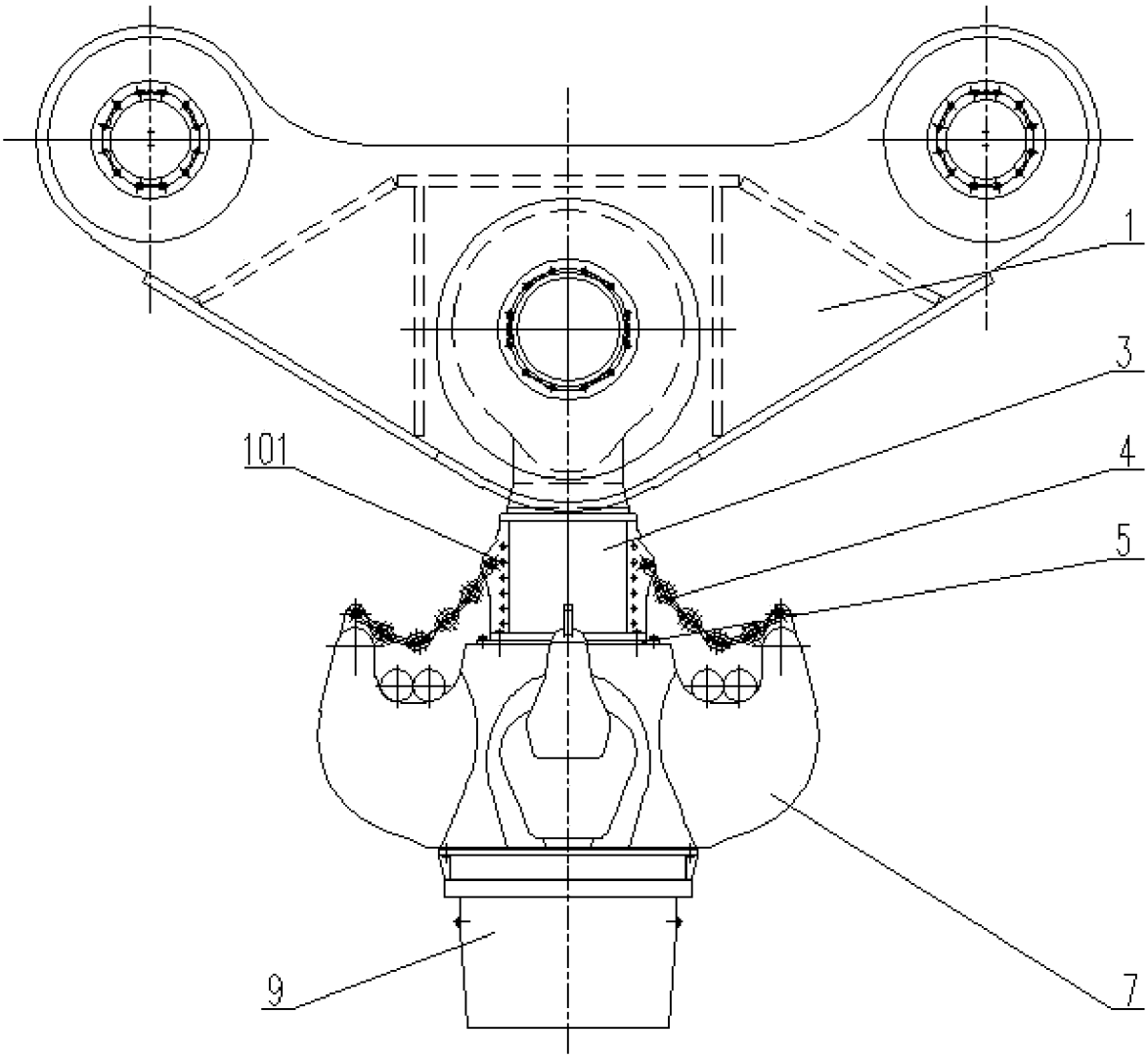
FIG. 2 is a schematic diagram of assembling structure of the super large tonnage detachable hook disclosed by the present invention
Figure 3:
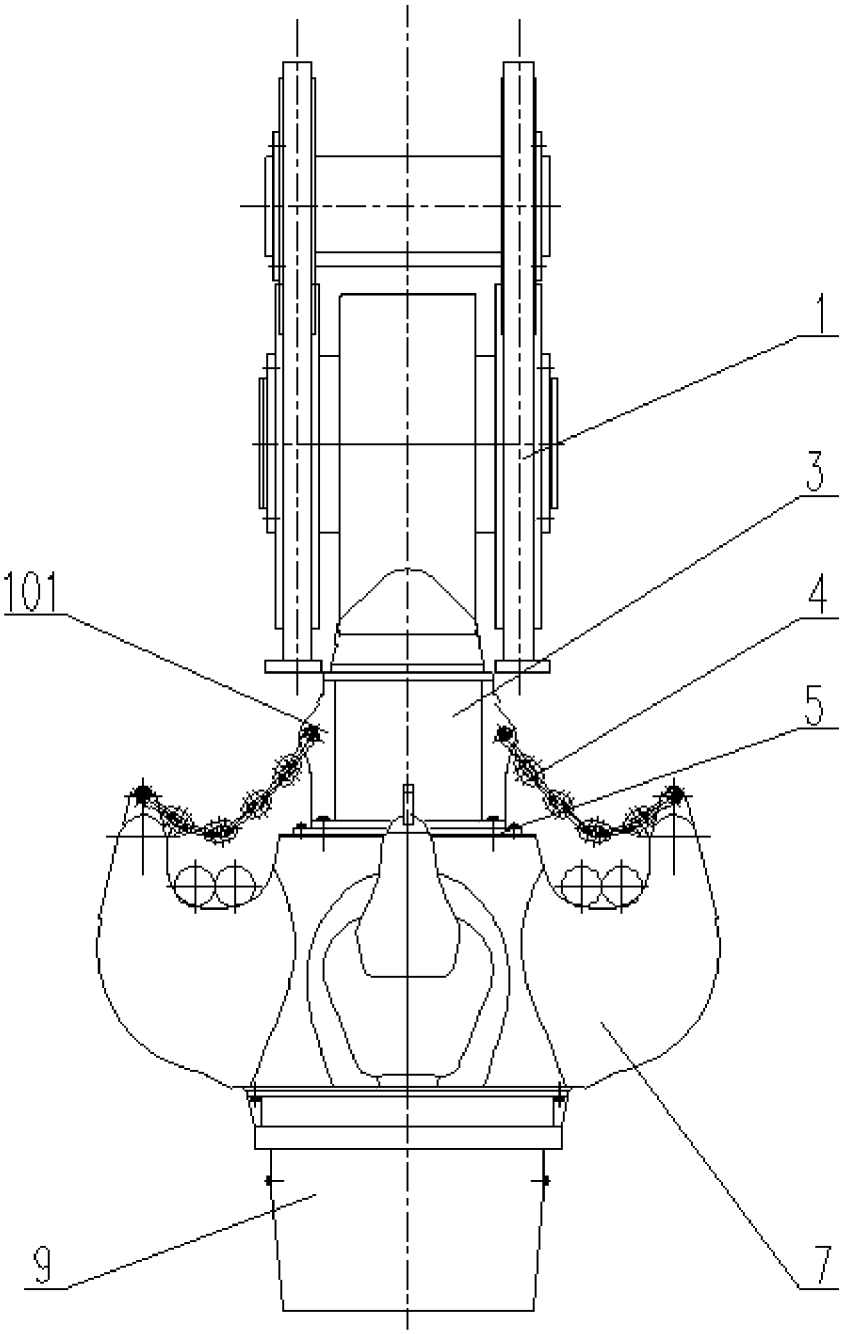
FIG. 3 is a side view of FIG. 2

The hook beam 1 can be respectively connected to a movable pulley group, and each end of the connecting beam 1 is respectively connected with a movable pulley frame employing a pin shaft. A pin hole is provided at a middle portion of the hook beam 1, and the hook beam is connected with the hook shaft via the pin hole to connect the two movable pulleys so that the hook beam can be mounted with a lifting hook with a larger lifting capacity. FIG. 2 shows the detachable hook of the present invention with a single hook, the lifting capacity of which can be as high as 5,000 tons and above.

The hook beam 1 adopts a semi-closed box structure, and the two ends of the hook shaft 2 adopt fixing shafts to avoid the connection of a shaft-locked plate which moves axially. This structure facilitates the assembling of the lifting hook.

Figure 4:
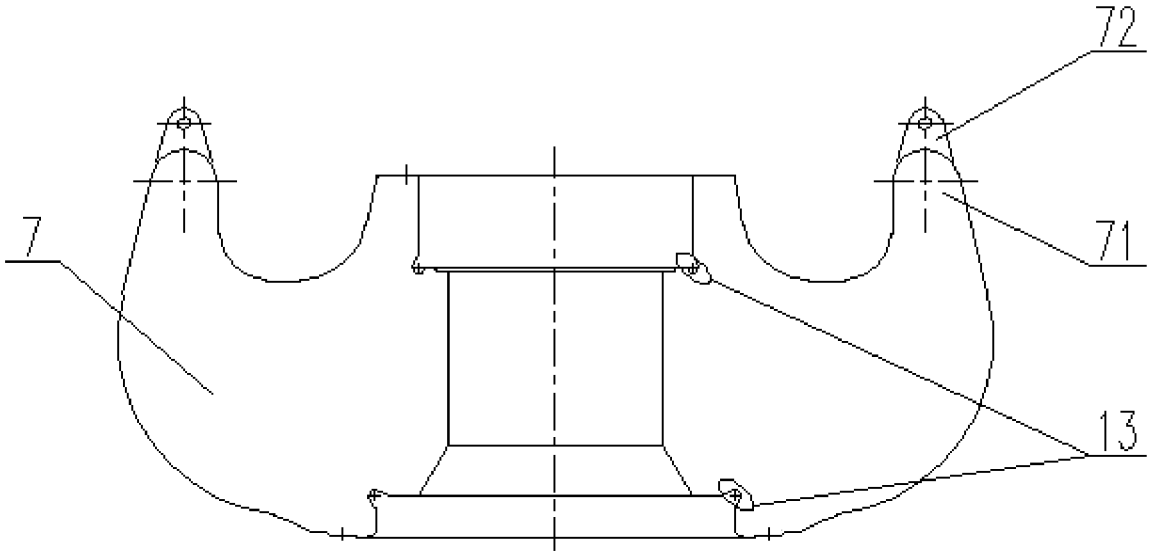
FIG. 4 is a front view of a super large tonnage detachable hook disclosed by the present invention
Figure 5:
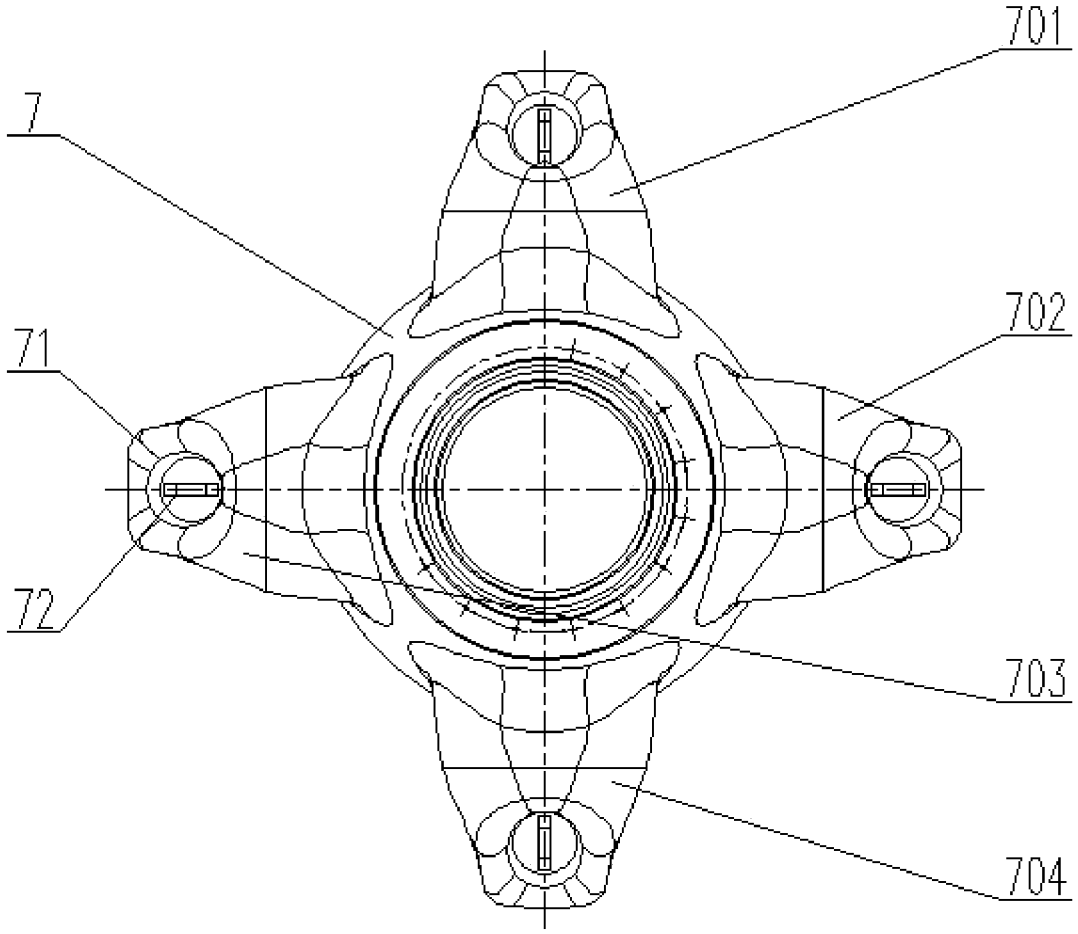
FIG. 5 is a top view of a super large tonnage detachable hook disclosed by the present invention

As shown in FIG. 4-5, the hook body 7 comprises two or more claws, four preferably. FIG. 5 shows the hook body 7 with four claws: a first hook claw 701, a second hook claw 702, a third hook claw 703, and a fourth hook claw 704. For the convenience of assembling, two claws can satisfy the requirement of lifting capacity. The probable stress concentration area at the bearing installation part undergoes special treatment. At the corner of the bearing mounting surface, the method of digging a Chamfer 13 is employed instead of the common rounded transition method, guaranteeing a smooth process for assembling bearing, as well as avoiding the problem of early cracking at this part of traditional detachable hooks. The whole bearing part of the hook is integrally forged, including the hook tip 71 and the hook body 7, modifying the welded structure of the hook tip and hook body of traditional hooks, and solving the problem that the hook tip is separated from the hook body under the pulling force of the wire rope of the stable hook during the offshore operation.

Figure 6:
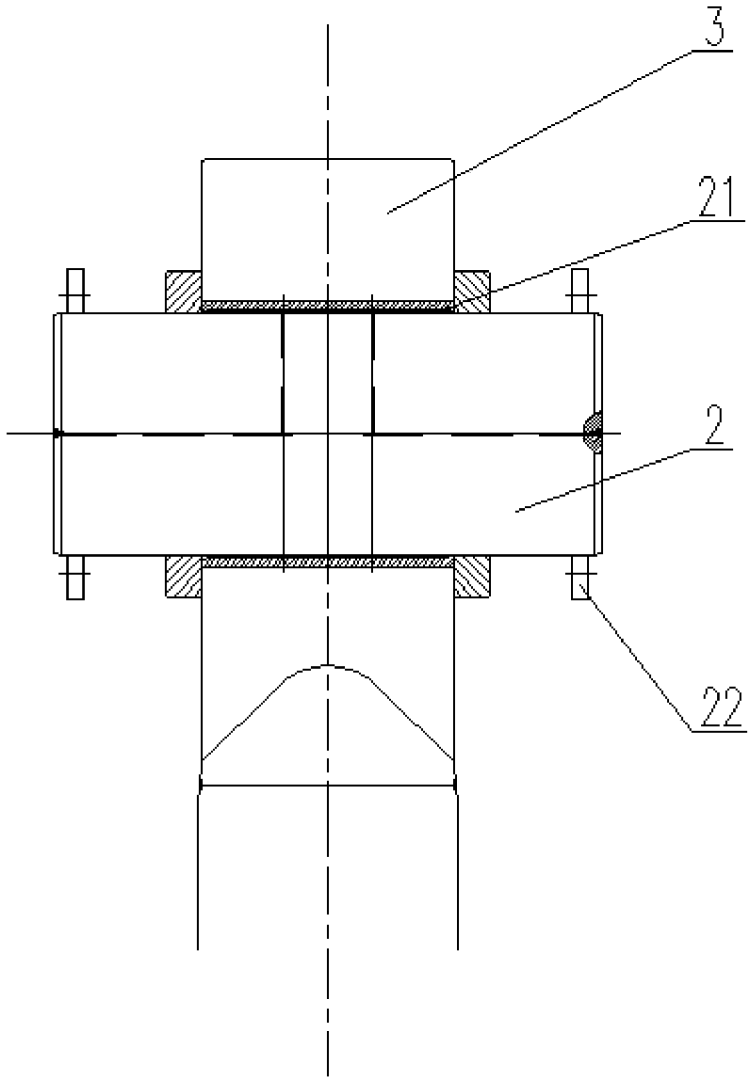
FIG. 6 is a schematic diagram of the hook shaft of a super large tonnage detachable hook disclosed by the present invention

As shown in FIG. 6, the hook shaft 2 is mounted above the hook rod 3 for steadier fixing and displacement avoiding. A sliding bearing 21 is provided at the connecting part between the hook shaft and the hook rod and a shaft-end baffle 22 is provided at the two ends of the hook shaft.

Figure 7:
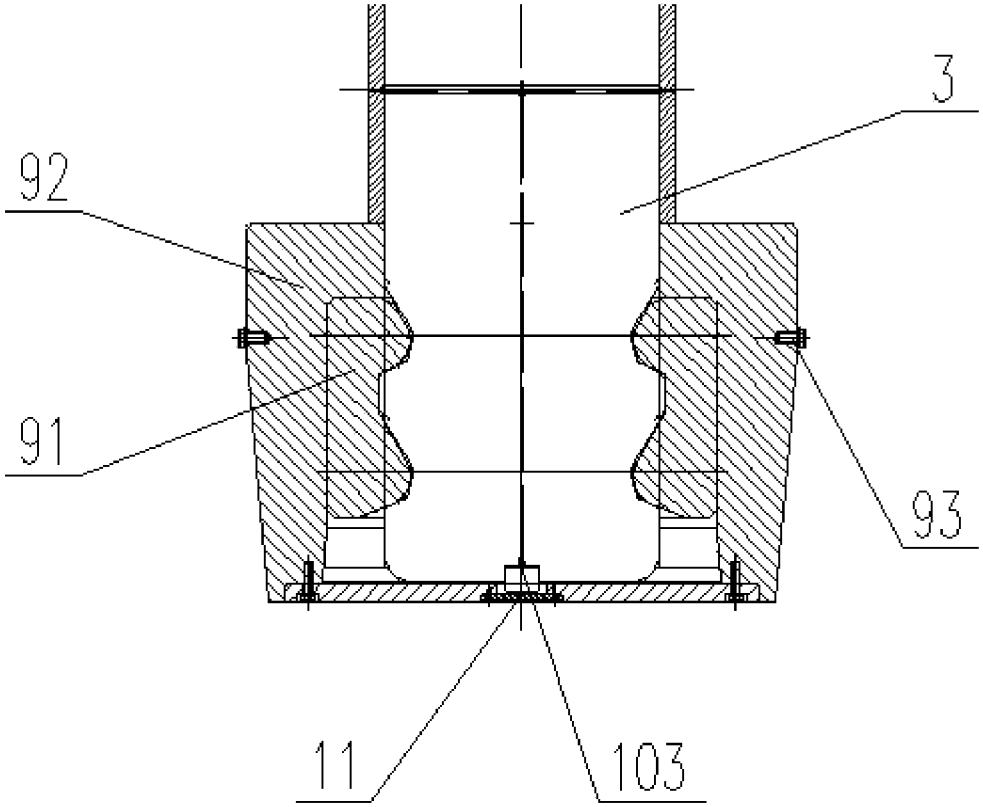
FIG. 7 is a schematic diagram of the structure of the embracing-type hoop holder assembly of a super large tonnage detachable hook disclosed by the present invention

The embracing-type hoop holder assembly 9 is employed to fixedly connect the hook rod 3 and the hook body 7. As shown in FIG. 7, the embracing-type hoop holder assembly 9 comprises a split-type self-locking sleeve 91 and a hoop holder 92 arranged beneath the thrust spherical roller bearing 8; wherein the split-type self-locking sleeve 91 is fixedly connected to the hook rod 3 by the hoop holder 92, thereby achieving the lifting capacity of several thousand tons. In some embodiments, the embracing-type hoop holder assembly 9 further comprises a bottom cover 10 employed to engage with the split-type self-locking sleeve 91 to fix the hoop holder 92.

Figure 8:
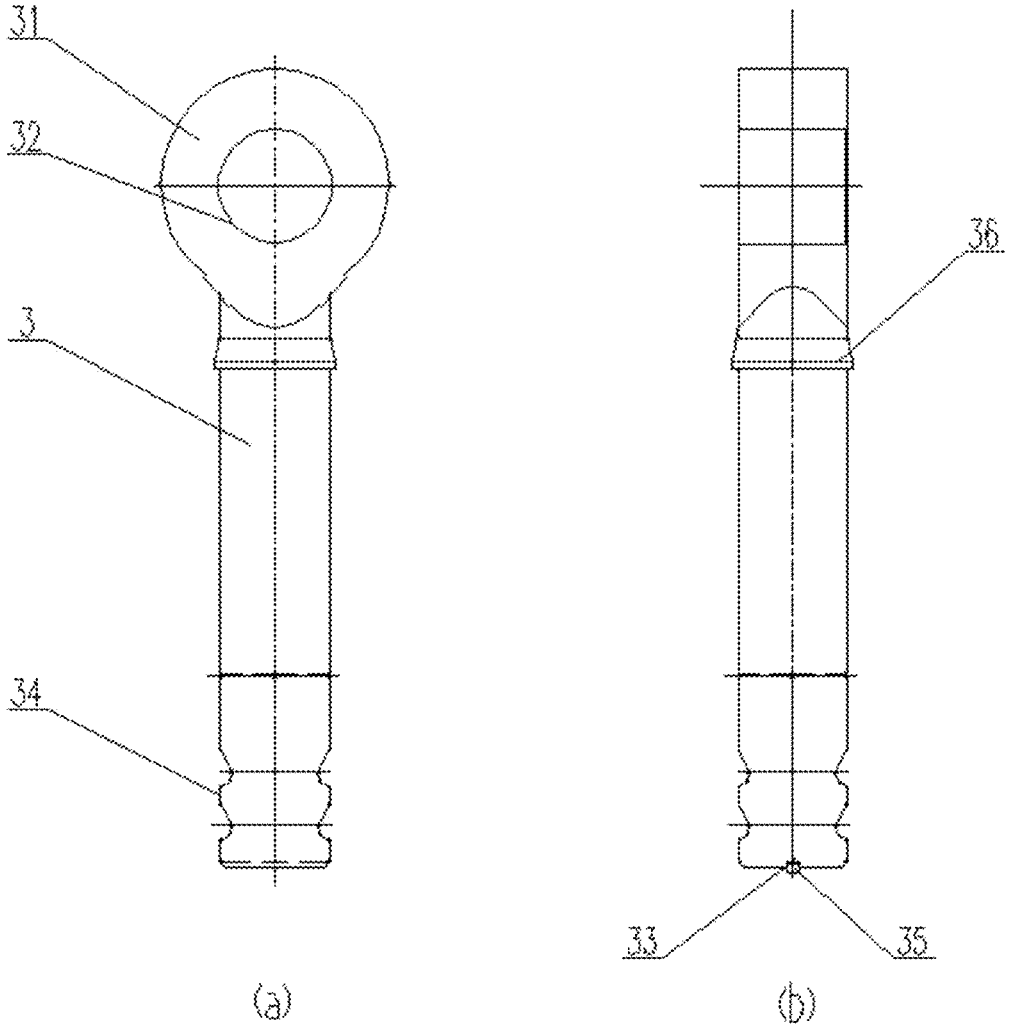
FIG. 8 is a schematic diagram of the hook rod of a super large tonnage detachable hook disclosed by the present invention (a): front view, (b): side view
Figure 9:
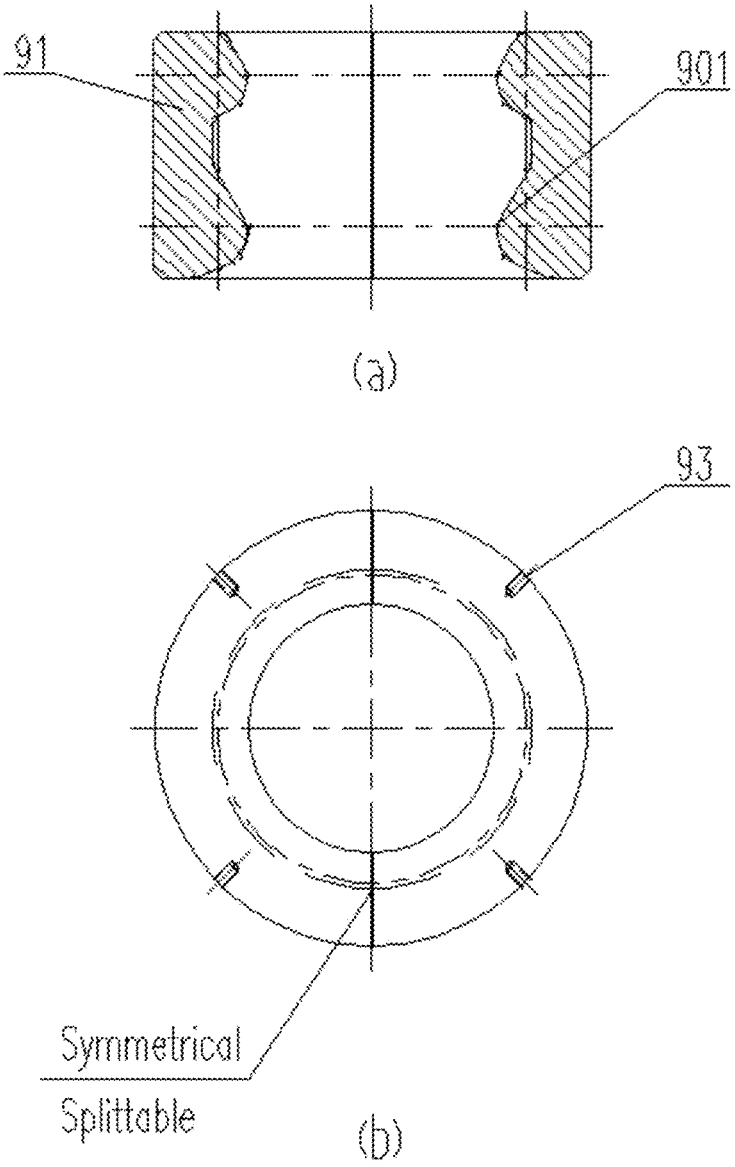
FIG. 9 is a schematic diagram of the split-type self-locking sleeve of the super large tonnage detachable hook disclosed by the present invention (a): front view, (b): top view

As shown in FIG. 8, an installation hole 32 is arranged on the rod head 31 for installing the hook shaft 2. A sliding bearing 21 is installed between the installation hole 32 on the upper portion of the hook rod 3 and the hook shaft 2, thereby guaranteeing the smooth right-and-left swinging of the lifting hook during operation, expanding the utilization scope of the lifting hook, reducing the horizontal force exerting on the hook rod 3, and enhancing the operation security thereof. A central oil hole 33 is arranged at the bottom of the hook rod 3 to refuel from the bottom so that oil enters the inside of the thrust bearing via the oil groove and an effective lubrication is achieved, thereby guaranteeing the service life of the bearing. A groove 34 is provided at a lower portion of the hook rod 3 where the hoop holder 92 is connected, a shoulder (as shown in FIG. 7) corresponding to the groove 34 is provided on the split-type self-locking sleeve 91, and the groove and the shoulder constitute a load bearing pair.

The shoulder 36 above the hook rod 3 engages with the chain bracket 101 to ensure axial positioning, and transmits the vertical upward load to the chain bracket 101 through the hook body, and then to the shoulder on the hook rod and further to the connecting shaft when the hook lands on the ground, so as to ensure that the inner and outer rings of the thrust bearing will not be separated and that the bearing will not be damaged due to the reverse force. Thus, the problem that the traditional hook can only bear the downward load is solved. Further, the detachable hook of the present invention is suitable for special work requirements that the hook may need to enter the water and land during offshore operation.

A rubber seal ring 102 is employed between the rotating and non-rotating parts, to prevent sea water or salt mist at sea from entering the inside of the hook bod, thereby protecting the bearing and extending the bearing life, to adapt to the special environmental conditions of offshore construction.

The bottom cover 10 can also protect the fueling nozzle (i.e. the central oiling hole 33), and the grease nipple 11 in the middle portion of the bottom cover 10 can facilitate oil filling. The traditional detachable hooks are lubricated with oil from the side cover, and the oil quickly runs out from the gap of the cover, resulting in poor lubrication effect.

A stop block 103 is installed on the bottom cover 10, which engages with a non-rotating groove 35 at the bottom of the hook rod 3 to stop the rotation of the hook rod, thereby ensuring that the hook body can rotate when the lifting parts need to be adjusted.

The hoop holder 92 used to fix the split-type self-locking sleeve 91 is smooth and conical in shape for convenient hoisting in the installation process, and four threaded holes are set on the outside of the hoop holder which can be installed with four bolts 93 and used as hoisting points when necessary.

The split-type self-locking sleeve 91 of the present invention is easy to install, and needs to be fixed only by the hoop holder and the bottom cover 10. Furthermore, only two shoulders are needed to constitute a load bearing pair with the two grooves of the hook rod, achieving a lifting capacity of several thousand tons. Compared with a traditional detachable hook using threaded connection, such a structure is simple and compact, with large loading capacity, easy to process, and convenient for assembling and dissembling.

Figure 10:
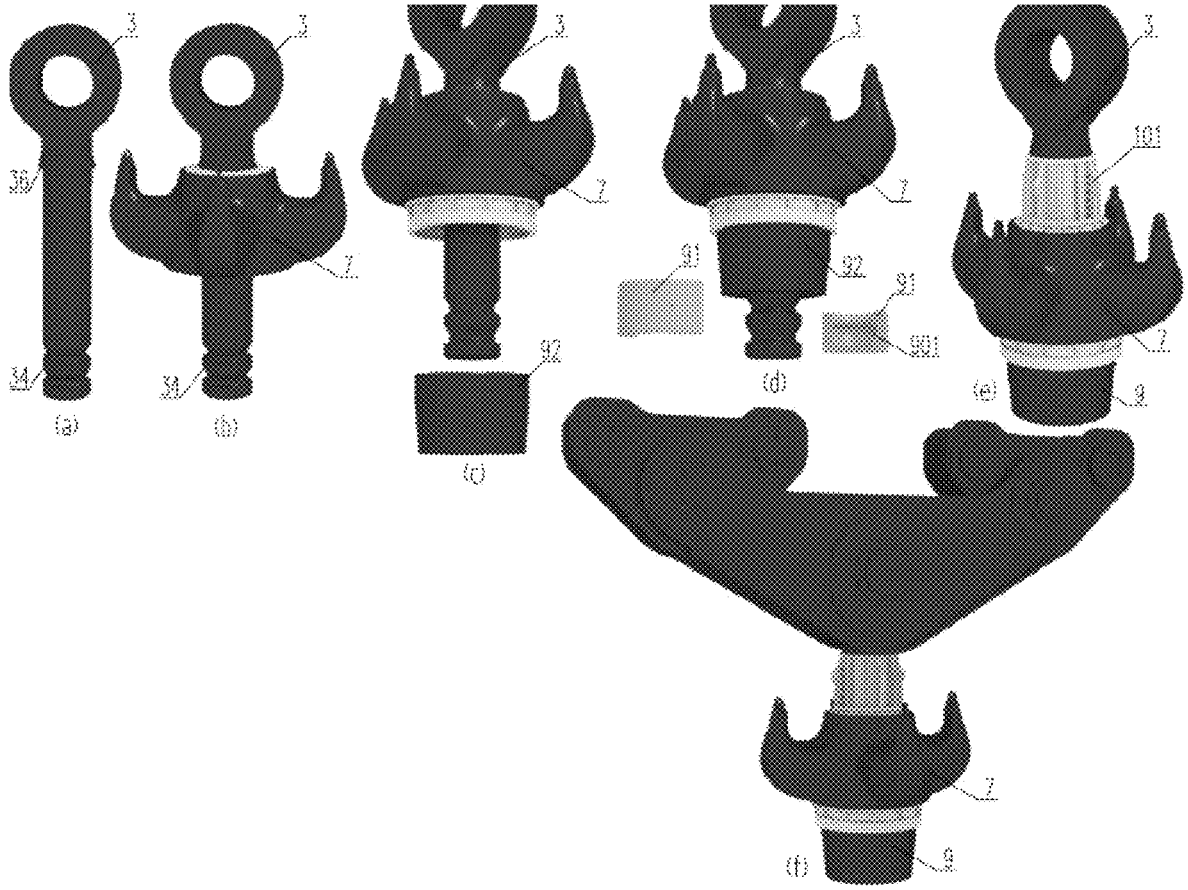
FIG. 10 is a three-dimensional view of the assembly process of the super large tonnage detachable hook.

As is shown in FIG. 10, assembling of the detachable hook of the present invention is as follows: (a) the hook rod 3 is lifted vertically, (b) the hook body 7 is installed starting from bottom to top, (c) the hoop holder 92 is installed starting from bottom to top, (d) the split-type self-locking sleeve 91 is installed on the hook rod teeth 34, (e) the hoop holder 92 is put down to compress the split-type self-locking sleeve 91, and the chain bracket 101 is installed, (f) it is completed after the hook beam 1 is installed.

The hook rod and the hook body of the detachable hook of the present invention are separately forged, heat treated, and machined, and then assembled ensemble employing a bearing, thereby solving the problems of huge structure and machining difficulty of integral hooks, and avoiding the problems of large amount of post-machining after integral forging and the waste of materials.

In some embodiments, the hook rod, hook body, sleeve, and hoop holder are integrally forged separately employing a high-strength alloy steel 30CrNiMo, which must simultaneously satisfy the DIN-EN10250-3 "Alloy Special Steel" standard and the classification society's provisions on the impact toughness of forging materials at a low temperature, thus meeting the special requirements of offshore operations. The basic properties of the material are listed in Table 1 and Table 2.

TABLE 1

| Steel Grade and Chemical Compositions | | | | | | | | | | |
|---|---|---|---|---|---|---|---|---|---|---|
| Name of Steel | | C | Si | Mn | $P_{max}$ | $S_{max}$ | Cr | Mo | Ni | V |
| Name | Value | % | % | % | % | % | % | % | % | % |
| 30CrNiMo8 | 1.6580 | 0.26-0.34 | <0.40 | 0.3-0.6 | 0.035 | 0.035 | 1.8-2.2 | 0.3-0.5 | 1.8-2.2 | \ |

TABLE 2

| Mechanical Properties in the State of Quenching and Tempering | | | | | | | | | |
|---|---|---|---|---|---|---|---|---|---|
| | | | | | Breaking $A_{min}$ % | Elongation | Impact Energy $KV_{min}$ J | |
| Name of Steel | | Yield Strength | Tensile Strength | | Longitudinal | Transverse | Longitudinal | Transverse |
| Name | Value | $R_{emin}$ N/mm$^2$ | $R_{emax}$ N/mm$^2$ | | L | TR | L | TR |
| 30CrNiMo8 | 1.6580 | 590 | 800 | | 12 | 8 | 40 | 20 |

Compared with the commonly used hook materials DG20Mn, 35CrMo, 20CrMnMo, etc., 30CrNiMo8 has high strength and good performance, and can meet the special requirements of offshore construction. When 30CrNiMo8 is employed for the manufacturing of super tonnage integral hooks, the weight of the hook can be reduced, the overall performance of the hook can be better ensured, and the active load acting on the entire floating crane and the lifting vessel can be reduced, thereby the cost of the entire crane vessel can be reduced.

The detachable hook of the present invention is integrally forged employing high-strength alloy steel. Compared with a cast hook, the forged hook has compact structure, few defects, high strength, and no residual slag during casting, thereby eliminating the risk of early cracking caused by casting. The detachable hook of the present invention is formed by machining after integral forging, and the dimensional accuracy is high. Moreover, compared with the traditional carbon gauging and sanding method, the process does not damage the heat treatment layer on the hook surface, and can avoid heat-treated cracks on the hook surface, which guarantees the heat-treated property of the hook surface; the strength of the hook body and the hardness of the hook surface are also ensured, and wear of the hook surface due to insufficient hardness during use can be avoided, and the service life of the hook is prolonged.

In summary, the detachable hook of the present invention is integrally forged by high-strength alloy steel, with large lifting capacity of a single hook, high strength and good fatigue performance. It innovatively applies the connecting method of embracing-type hoop holder assembly, hoop holder and hook rod teeth to replace the thread connecting used by traditional hooks, to realize high bearing capacity, low processing difficulty and easy assembly. For the first time, the rubber seal ring is used on the detachable hook to prevent sea water or salt mist from entering the inside of the hook body under certain pressure, i.e. in certain water depth, to protect the bearing and prolong the bearing life. The unique two-way force transmission system enables the hook to transfer the reverse load to the hook shaft through the hook frame and the hook rod when the hook lands and reserve force occurs and when the hook mainly bears the downward lifting load, to avoid the separation of the thrust bearing and the damage to the bearing. The present invention thus solves various shortcomings and deficiencies in existing hooks, meeting the requirements in various adverse working conditions of offshore operation of large tonnage lifting hooks.

Although the present invention has been described in detail by the preferable embodiments thereof, it should be understood that the foregoing description should not be construed as limiting. Various modifications and alterations of the present invention will be apparent to those skilled in the art. Therefore, the scope of the invention shall be defined by the appended claims.

So far, the present invention has been exemplified by the aforementioned embodiments. Without violating the spirit and principle of the present invention, those skilled in the art can modify the technical scheme of the above embodiments or replace their technical features, and all modifications, alterations and improvements shall fall within the scope of power protection of the invention.

The invention claimed is:

1. A super large tonnage detachable hook, comprising a movable pulley group, a hook rod, a hook shaft, a hook body, a spherical roller bearing and a thrust spherical roller bearing, wherein the detachable hook further comprises an embracing-type hoop holder assembly which connects the hook rod and the hook body and comprises a split-type sleeve, and a hoop holder set beneath the thrust spherical roller bearing; the hoop holder is fixedly connected to the hook rod via the split-type sleeve.

2. The super large tonnage detachable hook according to claim 1, wherein the hook body comprises two or more hook claws.

3. The super large tonnage detachable hook according to claim 1, wherein the hook rod and the hook body are each forged, heat treated, machined separately and then assembled together employing a bearing.

4. The super large tonnage detachable hook according to claim 3, wherein the hook rod and the hook body are integrally forged employing high-strength alloy steel 30CrNiMo8.

5. The super large tonnage detachable hook according to claim 1, wherein the embracing-type hoop holder assembly further comprises a bottom cover which engages the split-type sleeve to fix the hoop holder.

6. The super large tonnage detachable hook according to claim 1, wherein a groove is provided at a lower portion of the hook rod whereat the hoop holder is connected therewith, a bump corresponding to the groove is provided on the split-type sleeve, and the groove and the bump constitute a load bearing pair.

7. The super large tonnage detachable hook according to claim 1, wherein a central oil filling hole is provided at bottom of the hook rod for refueling from the bottom so that oil enters inside of the thrust spherical roller bearing via an oil groove for effective lubrication and increased service life of the thrust spherical roller bearing.

* * * * *